United States Patent [19]

Terashima

[11] 4,332,111

[45] Jun. 1, 1982

[54] FIREPROOF WINDOWPANE AND MOUNTING FRAME THEREFOR

[75] Inventor: Kenzi Terashima, Nishinomiya, Japan

[73] Assignee: Nippon Sheet Glass Co., Ltd., Osaka, Japan

[21] Appl. No.: 127,520

[22] Filed: Mar. 5, 1980

[30] Foreign Application Priority Data

Mar. 9, 1979 [JP] Japan ..... 54-30082[U]
Mar. 10, 1979 [JP] Japan ..... 54-31158[U]

[51] Int. Cl.[3] ..... E04H 9/00; E06B 7/12

[52] U.S. Cl. ..... 52/1; 52/172; 52/397; 52/398; 52/455; 52/788; 52/825

[58] Field of Search ..... 52/1, 171, 172, 232, 52/397, 398, 303, 825, 824, 823, 455, 788, 476

[56] References Cited

U.S. PATENT DOCUMENTS

| | | | |
|---|---|---|---|
| 762,472 | 6/1904 | Dowman | 52/455 X |
| 825,002 | 7/1906 | Mullins et al. | 52/455 X |
| 897,415 | 9/1908 | Sanders | 52/823 |
| 983,794 | 2/1911 | Wolff | 52/455 X |
| 1,171,443 | 2/1916 | Larson et al. | 52/455 X |
| 2,159,661 | 5/1939 | Knudsen | 52/1 |
| 2,593,050 | 4/1952 | Paul et al. | 52/232 |
| 2,680,269 | 6/1954 | Watkins | 52/172 |
| 2,694,476 | 11/1954 | Hanssen | 52/825 |
| 3,205,630 | 9/1965 | Felix et al. | 52/455 X |

FOREIGN PATENT DOCUMENTS

| | | | |
|---|---|---|---|
| 2328737 | 12/1974 | Fed. Rep. of Germany | 52/171 |
| 1205110 | 9/1970 | United Kingdom | 52/455 |

*Primary Examiner*—Alfred C. Perham
*Attorney, Agent, or Firm*—Wenderoth, Lind & Ponack

[57] ABSTRACT

A fireproof windowpane in which a glass plate having metallic wires incorporated therein is fitted in the grooves of a mounting metal frame to a depth corresponding to at least about 1.6 times the thickness of the glass plate at least at its upper edge. Also provided is a mounting metal frame for mounting fireproof windowpanes which has grooves for receiving the metallic wire-containing glass plate therein to the aforesaid depth. The fireproof windowpane can withstand fire or high temperatures over a long period of time, and is useful for preventing spreading of a fire and for aiding in fire extinguishing activities.

7 Claims, 10 Drawing Figures

40
26
25
27
14
24
18
23
29
28
30
22
21
15

121
115
114
132
123
125B
112
117
127
125A
122
126
120
110
111
134
133
119

FIREPROOF WINDOWPANE AND MOUNTING FRAME THEREFOR

This invention relates to a fireproof windowpane comprising a glass plate having metallic wire incorporated therein (wire glass) and a metallic frame supporting it, and also to such a mounting metal frame. More specifically, this invention relates to a fireproof windowpane conveniently employed for providing indoor fireproof members having windowpanes, and to a mounting metal frame used for mounting such fireproof windowpanes.

Fireproof windowpanes comprising a metallic wire-containing glass plate and an iron frame, and fireproof doors equipped with such windowpanes have previously been known. The conventional fireproof windowpanes have the advantage that even when the glass breaks under heat, the glass fragments do not drop out. But they create problems because the edge of the metallic wire-containing glass plate is fitted in the mounting frame to a relatively small depth. For example, the glass plate softens upon exposure to a high-temperature atmosphere or to a fire, and partly drops out from the mounting frame at a relatively early stage. This is particularly so when the metallic wire-containing glass plate has a relatively large size and a relatively small thickness. Consequently, holes are formed in the windowpane, permitting passage of fire and smoke, and it is difficult to ensure the ability of the windowpane to inhibit spreading of fires for a sufficiently long period of time.

It is generally believed that in the structure a conventional fireproof windowpane, the sufficient depth to which the metallic wire-containing glass plate is fitted in the mounting frame is almost equal to, or slightly larger than, the thickness of the glass plate. Metallic wire-containing glass plates having a thickness of 6.8 mm and a short side length of at least about 300 mm which find wide application for fireproofing in buildings are mounted at their edge portion in mounting frames to a depth of about 6 to 8 mm, and metallic wire-containing glass plates having a thickness of 10 mm and the same short side length as above which likewise are widely accepted are mounted to a depth of about 10 mm.

When such a conventional fireproof windowpane is subjected to a high-temperature atmosphere or to a fire, it permits passage of fire within a relatively short period of time (although after a longer time period than in the case of using an ordinary glass plate not containing metallic wires). The work of the present invention has led to the discovery that the passage of fire is not due to the breakage of the glass plate but due mainly to the softening of the glass plate and its partial detachment from the mounting frame so as to generate a hole in the windowpane. The present inventor has found that this phenomenon is caused by the small depth to which the glass plate is fitted in the mounting frame; that when the depth of fitting of the glass plate is small at its upper edge portion while it is larger at the other edge portions, the formation of a hole owing to the softening of the glass plate cannot be effectively prevented; and that in order to prevent such hole formation effectively, at least the upper edge portion of the metallic wire-containing glass plate should be fitted in the mounting frame to a depth corresponding to at least 1.6 times the thickness of the glass plate.

It is an object of this invention therefore to provide a fireproof windowpane having a thickness of less than about 12 mm and a window opening with one side measuring at least about 300 mm, which when exposed to a high-temperature atmosphere or to a fire, can withstand high temperatures or fire for a much longer period of time than do conventional fireproof windowpanes, and therefore does not cause formation of holes, thus contributing to the prevention of spreading of the fire or to the fire extinguishing activities.

Another object of this invention is to provide a glass plate-mounting frame for fireproof windowpanes which does not cause formation of a hole even when exposed to higher temperatures than in the case of conventional fireproof windowpanes.

Still another object of this invention is to provide a structure of a fireproof windowpane which can fully withstand a fireproof heating test stipulated in JIS A1311 (JIS stands for Japanese Industrial Standards) while conventional fireproof windowpanes cannot withstand this test although they can withstand a fireproofing class 2 heating test stipulated in JIS A1311; and also a glass plate-mounting frame for such a fireproof windowpane.

A further object of this invention is to provide a structure of a windowpane which has especially good resistance to high temperatures and fire and in which a specified incombustible filler is provided in the spaces between the mounting frame and the glass plate fitted in the grooves of the mounting frame; and a structure of a fireproof double windowpane.

Other objects and advantages of this invention will become apparent from the following description.

According to this invention, there is first provided a fireproof windowpane comprising a metallic wire-containing glass plate and a mounting metal frame receiving the edge portions of said glass plate in grooves formed therein, characterized in that at least the upper edge portion of said glass plate is fitted in the corresponding groove to a depth at least about 1.6 times the thickness of said glass plate, and that an incombustible filler is provided in the spaces defined by the two surfaces of the edge portions of said glass plate and the inside surfaces of said grooves.

In another aspect, the present invention provides a mounting metal frame for supporting a metal wire-incorporated glass plate, said frame comprising a main body having inwardly projecting portions along the entire inner surface of said frame in the direction of the thickness of said frame and batten members each detachably mounted along the entire inwardly facing surface of the main body and spaced away from the projecting portions of the main body, said projecting portions and said batten members defining a groove along the entire inner surface of said frame for fitting the glass plate therein, and said main body having provided along its upper side a recess so as to make said groove deep.

This invention is described below in more detail in connection with the accompanying drawings, in which.

Figure 1:
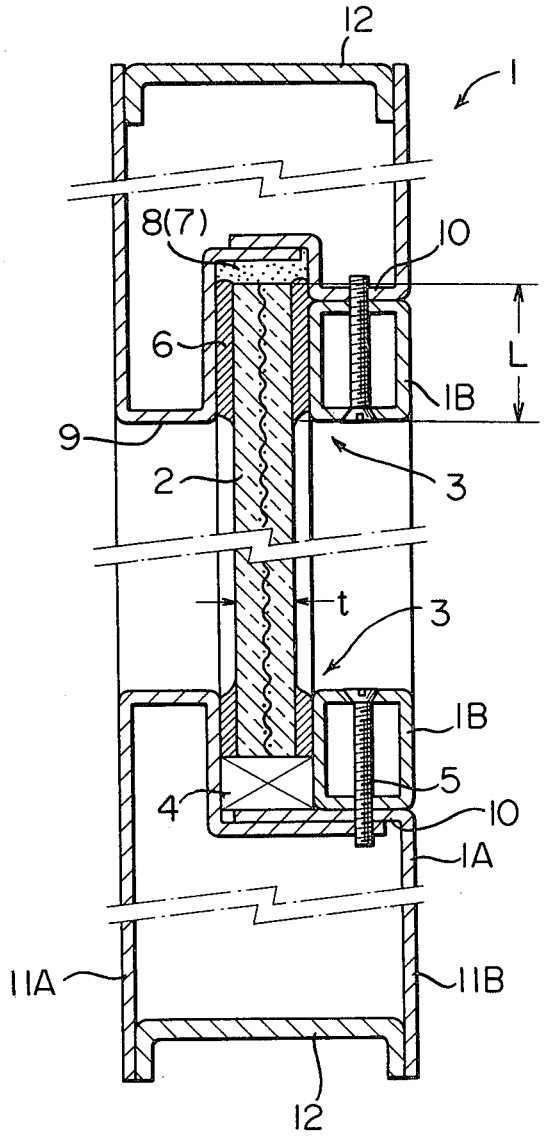
FIG. 1 is a sectional elevation view of a fireproof door with a fireproof windowpane according to the present invention therein.

The fireproof windowpane of this invention is composed of a glass plate containing metallic wires and a mounting metal frame supporting the glass plate, and the mounting metal frame consists of a main body and batten members.

In the fireproof windowpane of this invention, the metallic wire-containing glass plate is fitted in the grooves of the mounting frame, and at least the upper edge portion of the glass plate is fitted in the corresponding groove to a depth corresponding to at least about 1.6 times the thickness of the glass plate.

The investigations of the present inventor have shown that the fire blocking ability of a fireproof windowpane comprising a metallic wire-containing glass plate in the event of fire which lasts for a long period of time depends upon its resistance to the partial detachment of the glass plate from the mounting frame, and particularly upon the depth to which the edge portion of the glass plate is fitted in the upper groove of the mounting frame. The depth to which the edge of the glass plate is fitted in the upper groove should be at least about 1.6 times the thickness of the glass plate. Preferably, the depth is about the same in the side grooves. It is not necessary however to fit the glass plate to the same depth as above in the lower groove, and the depth in the lower groove may be the same as in the case of conventional fireproof windowpanes.

The depth to which the glass plate is fitted in the groove of the mounting frame in the fireproof windowpane of this invention is generally about 1.6 to about 3 times the thickness of the glass plate. Larger depths than this upper limit do not bring about any further improvement in fire blocking property. When the depth of fitting is about 2.5 times the thickness of the glass plate, the fire blocking property almost reaches saturation, and when the depth is about 3 times the thickness of the glass plate, no further improvement in the fire blocking property can be expected. Accordingly, the depth is set so as to be within the aforesaid range in consideration of economy, the appearance of the windowpane, etc. Preferably, the depth is at least about 2.0 times the thickness of the glass plate.

In the fireproof windowpane of this invention, the edge portions of the glass plate are fitted in the grooves of the mounting frame, and an incombustible filler is filled in the spaces provided between both glass surfaces at the edge portions and the inside surfaces of the grooves. If organic sealing materials or rubbers are used to fill the aforesaid spaces, they eventually burn in the event of fire, and the fire blocking property of the fireproof windowpane cannot be achieved fully even when the depth to which the glass plate is fitted is increased.

Examples of the incombustible filler used in this invention are inorganic fillers such as refractory clay, glass fibers, ceramic fibers, asbestos, gypsum, and glass putty stipulated in JIS A5752, used either singly or in combinations of two or more. These inorganic fillers may be used after impregnation of hydrous sodium silicate therein.

The fireproof windowpane of this invention filled with such an incombustible filler may also have a layer of an organic sealant such as butyl rubber, silicone rubber or polysulfide in order to increase its water-tightness or air-tightness. A ribbon-like length of the butyl rubber sealant can be favorably used for the formation of such a sealant layer. It will be readily understood from the foregoing description that the fire blocking property of a fireproof windowpane containing such an organic sealant alone instead of the incombustible filler differs from that of the fireproof windowpane of this invention filled with the combustible filler.

Inorganic fillers containing hydrous sodium silicate, for example fibrous inorganic fillers such as glass fibers, asbestos fibers and ceramic fibers impregnated with hydrous sodium silicate are especially preferred as the incombustible filler used in this invention. These fillers can be used in the form of a mat impregnated with hydrous sodium silicate, or as a molded article in the form of ropes or ribbons. In the fireproof windowpane of this invention having such an inorganic filler containing hydrous sodium silicate as the incombustible filler, the hydrous sodium silicate becomes anhydrous and foams upon heating. Thus, when the fireproof windowpane is exposed to a fire or high temperatures, the hydrous sodium silicate is swollen within the grooves of the mounting frame to restrain the glass plate more firmly within the grooves and prevent detachment of the glass plate from the grooves.

The especial preference of the incombustible fillers impregnated with hydrous sodium silicate in this invention is based on the fact that they give fireproof windowpanes outstanding fire blocking ability.

The metal wire-containing glass plate used in this invention need not to be special, and any metal wire-containing glass plate ordinarily for this purpose may be used in this invention. For example, a glass plate containing parallel metallic wires therein, and preferably a glass plate having a meshwork of metallic wires, may be used.

The investigations of the present inventor have shown that in a fireproof windowpane comprising a metal wire-containing glass plate in which the metallic wires form a meshwork, better fire blocking ability is obtained when the metallic wires of the glass plate are laid oblique to the sides of the mounting frame to form a rhombic meshwork than when they are laid parallel thereto. This is presumably because in the rhombic meshwork, the weight of the softened glass plate is dispersed by the rhombic meshes and supported from above.

The fireproof windowpane of this invention can be used, for example, for windowpanes in the side walls of a building, or as windowpanes in fireproof doors secured to a building.

The fireproof windowpane of this invention has a very good fire blocking property as described in Examples to be given hereinbelow which show that heating is required for a very long period of time before the metal wire-containing glass plate can no longer support the load of the lower portion of the windowpane at a position near the upper side of the mounting frame and is detached as if it were torn off.

Specifically, since the depth to which the upper edge portion of the glass plate is fitted in the groove is sufficiently large, even when the upper edge of the glass plate softens and deforms, a long period of time is required until it is displaced from the mounting frame. Furthermore, since a large area is provided for the contact of the incombustible filler with the glass plate, the holding of the edge portions of the glass plate by the frictional force of the filler is firm. These two effects combine to prevent abrupt formation of a large hole unless the metallic wires in the glass plate are cut off.

In contrast, in a conventional fireproof windowpane, the depth to which the metal wire-containing glass plate is fitted is small, and the holding of the glass is insufficient especially at the upper side of the mounting frame. Accordingly, the glass plate, when it comes loose during a fire, is not detached as if it were torn off as is the windowpane of this invention, but comes out well before that time, because the upper portion of the glass plate cannot support the lower portion which is softened and becomes deformed. Consequently, the glass plate comes out of the upper portion of the frame and leaves a large hole which permits passage of fire.

The fireproof windowpane of this invention is described below in more detail with reference to the accompanying drawings.

Figure 2:
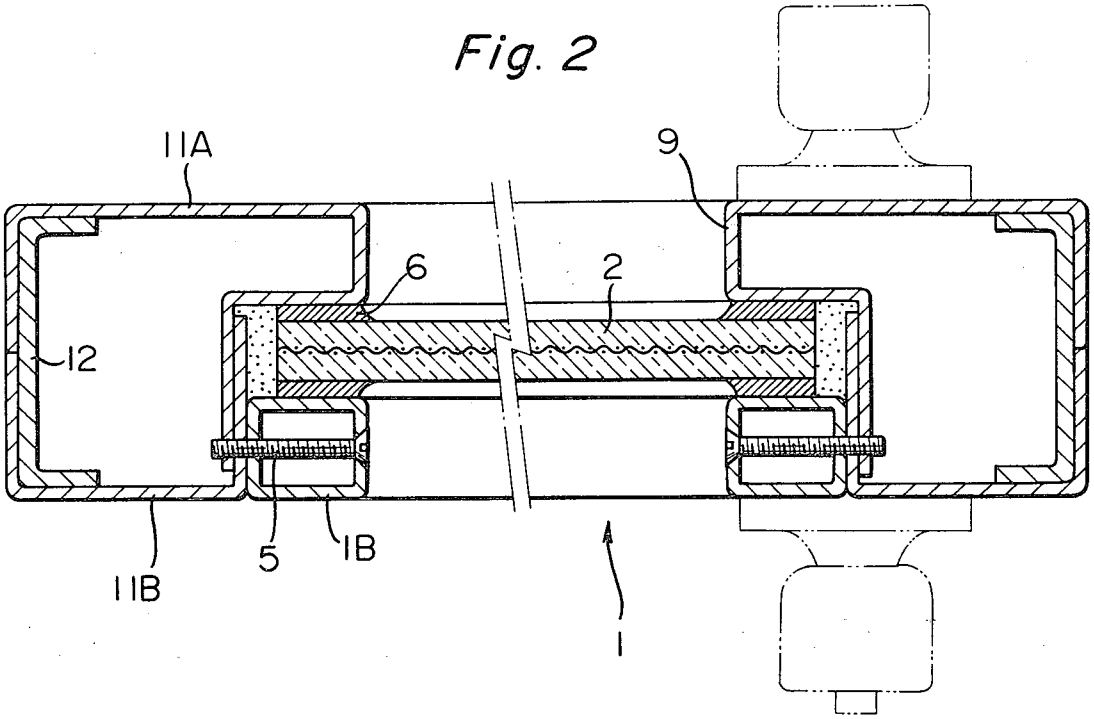
FIG. 2 is a horizontal section through the door of FIG. 1.

Referring to FIGS. 1 and 2, the reference numeral 1 designates an iron door including a door body 1A and a metallic frame, and 2, a glass plate having metallic wires (mesh) incorporated therein. The edges of the metallic wire-containing glass plate 2 are fitted in grooves 3 in the frame 1 and the lower end of the glass plate is placed on a supporting block 4. An incombustible filler 6 is filled in the spaces between the glass plate 2 and the walls defining the groove. Each of the grooves 3 is defined by projecting portion 9 provided on the main door body 1A around the edges of the opening to be filled by the glass plate and a batten member 1B secured detachably to an inwardly facing portion 10 adjacent the bottom of the groove by a screw 5 and spaced from the projecting portion in the direction of the thickness of the main body 1A.

In the fireproof windowpane shown in FIGS. 1 and 2, the groove 3 at the upper portion of the frame 1 has a larger depth than the other grooves 3, i.e. those in the lower and side portions, the greater depth being provided by a recess 7 between the projecting portion 9 and the inwardly facing portion 10 provided on the main body 1A. Accordingly, the glass plate is fitted into the groove at the upper edge deeper than into the grooves at its other edges. The depth to which the upper edge portion L is fitted into the upper groove is at least 1.6 times the thickness of the glass plate 2.

The fireproof windowpane of this invention can be easily assembled by placing the supporting block 4, which is made of calcium silicate, etc., on that part of the lower portion of the main body 1A in which a groove 3 is to be formed, placing an incombustible filler 8 such as ceramic fibers having an elastic recovery characteristic on the surfaces of the frame around the upper and side portions of the opening in the main body 1A which constitute the bottom surfaces of the grooves, fitting the metal wire-containing glass plate 2 against the groove defining surfaces of the projecting portions 9, securing the batten member 1B to the inwardly facing portion 10 of the main body 1A by means of the screws 5, and then placing the incombustible filler 6 in the spaces left between the glass plate and the groove defining surfaces of the portion 9 and the batten 1B.

The fireproof door equipped with the fireproof windowpane shown in FIGS. 1 and 2 is constructed by bending panels 11A and 11B constituting the two surfaces of the main body of the door, placing a channel-shaped reinforcing beam 12 between the edge portions of the two panels, and forming them into a unitary structure. Preferably, the batten member 1B when it is attached to the main body of the frame has the inwardly facing surface at the same level as the projecting portion of the main body whether at the upper portion, bottom portion or side portion of the window. If the level of the batten member 1B is higher than that of the projecting portion 9, the level of the projecting portion is the basis for adjusting the depth to which the upper edge of the glass plate extends into the groove to at least 1.6 times the thickness of the glass plate. If the batten member is at a lower level than the projecting portion, the level of the batten member becomes the basis for the 1.6 times the thickness.

Figure 3:
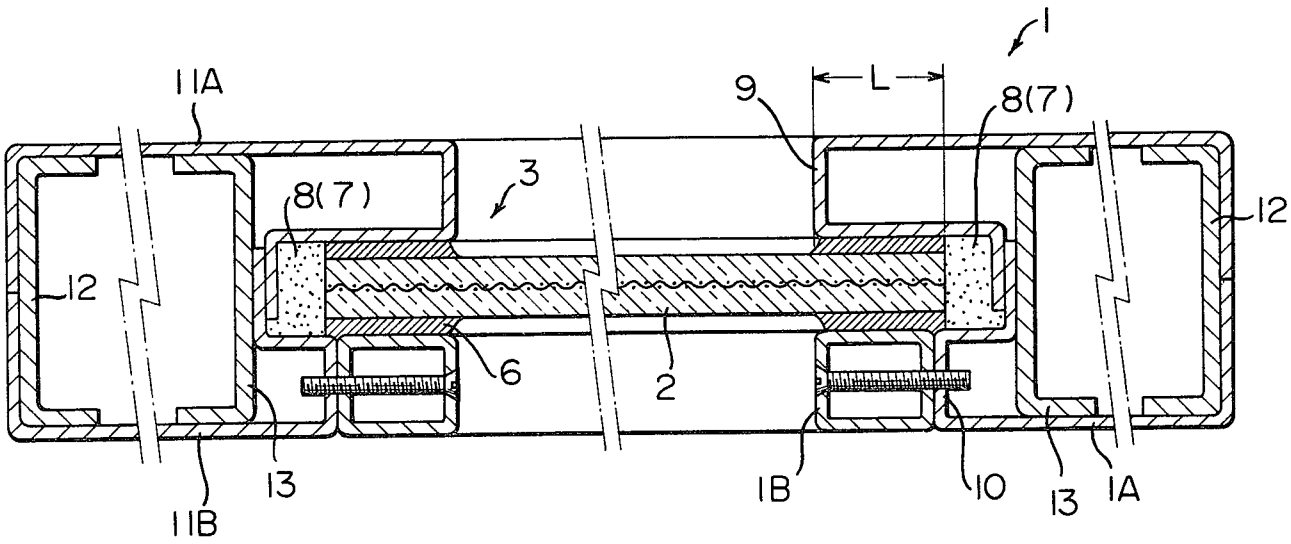
FIG. 3 is a horizontal sectional view of a fireproof door with a modified embodiment of the fireproof windowpane according to the invention therein.

In FIG. 3, corresponding parts are designated by the same reference numerals as in FIGS. 1 and 2. The fireproof door shown in FIG. 3 has two further characteristic features as compared with the one shown in FIGS. 1 and 2. Firstly, the metal wire-containing glass plate is fitted in the groove to a depth corresponding to at least about 1.6 times the thickness of the glass plate not only at the upper portion of the frame but also on both side portions as shown. Secondly, a channel-shaped reinforcing beam 13 is provided in contact with the bottom wall of groove 3 within an interior space defined between panels 11A and 11B forming the two surfaces of the main body of the door.

When a fireproof windowpane is exposed to a fire or high temperatures, the upper edge portion of the metal wire-containing glass plate easily comes out of the mounting frame, and the two side edge portions of the glass plate next easily become detached from the mounting frame. Accordingly, the glass plate shown in FIG. 3 which is mounted in the frame to a depth of at least 1.6 times the thickness of the glass plate not only at the upper portion but also at the two side edge portions of the frame is more surely prevented from becoming detached owing to the combination of the effects of these depths.

Generally, the panels 11A and 11B forming the main body of the door are made of metal such as iron. When exposed to a fire and high temperatures, they reach very high temperatures and it is not infrequent that they undergo deformation due to the heat. Sometimes, their deformation accelerates the detachment of the glass plate. Accordingly, it is preferred as shown in FIG. 3 to provide a channel-shaped reinforcing beam 13 in the interior spaces of the main body in contact with the bottom walls of the grooves.

Figure 4:
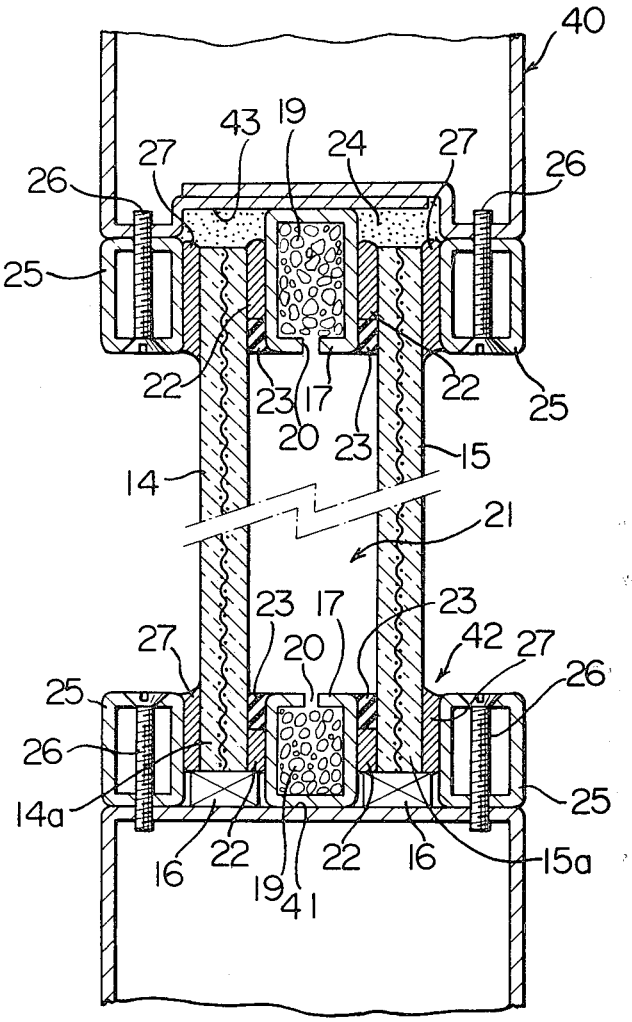
FIG. 4 is a sectional elevation of a fireproof door with a double fireproof windowpane according to the present invention therein.
Figure 5:
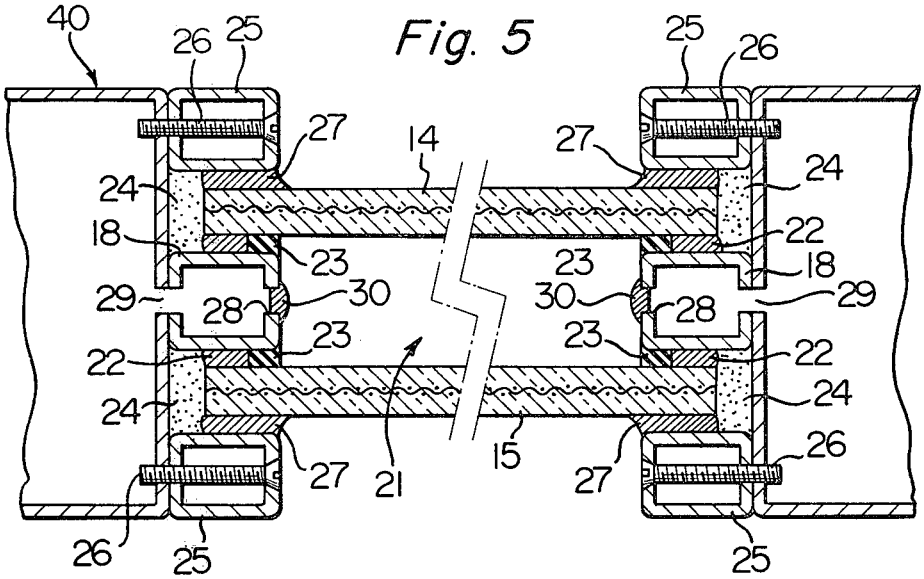
FIG. 5 is a horizontal section of the door of FIG. 4.

Referring to FIGS. 4 and 5, a main body of a fireproof door formed by bonding together press-shaped steel plates is shown at 40. An opening 41 constituting a window is formed in the main body 40. The bottom side and left and right sides of the upwardly facing surface around the opening 41 are formed flat, and grooves 42 of predetermined width and depth are subsequently defined by spacers 17 and 18 and batten members 25. The top surface (i.e. ceiling surface) around the opening 41, has a recess 43 extending upward so that the bottom of the grooves 42 in the top of the opening 41 is deeper than in the other surfaces (i.e., the bottom, left and right surfaces) forming the opening 41.

A plurality of, here shown as two, glass plates 14 and 15 having incorporated therein metallic wires are fitted in the grooves 42 formed in the main body 40 in parallel to each other. The lower ends 14*a* and 15*a* of the glass plates 14 and 15 are supported on supporting blocks 16 made of, for example, calcium silicate. The two glass plates are kept spaced from each other by providing (for example, welding) spacers 17 made of, for example, hollow rectangular steel pipes on the top and bottom surfaces of the inwardly facing surface and between the glass plates 14 and 15. As shown in FIG. 5, spacers 18 of the same structure and size are fixed to the left and right inwardly facing surfaces between the glass plates 14 and 15 to keep the two glass plates spaced from each other. In the illustrated embodiment, a dessicant 19 for moisture absorption is placed in the spacers 17, and a slit 20 is provided on the inner surfaces of the spacers 17 so that the inside of each spacer 17 communicates with the space 21 formed between the glass plates 14 and 15. This serves to remove moisture and dry the intermediate space 21, thereby preventing dew formation and insuring transparency of the glass plates.

An incombustible filler 22 and an organic sealing material 23 are filled in the spaces between the top and bottom portions and the left and right portions of the glass plates 14 and 15 and the two side surfaces of the spacers 17 and 18, respectively. The intermediate space 21 is thus sealed air-tight by the sealant material. In the illustrated embodiment, a ribbon-shaped sealant of a fixed size is used as the organic sealant material 23, and the incombustible filler 22 is placed outwardly of the sealing material 23. In this structure, the sealing material 23 constitutes a form for containing the filler 22 at the time of filling, and thus, the filler 22 can be easily positioned. This increases the efficiency of the mounting operation. The relative position of the filler 22 and the sealing material 23 may be reversed.

An incombustible filler 24 such as ceramic fibers is filled in the space between the edges of the glass plates 14 and 15 and the bottom walls of the recess 43 and the surfaces forming the bottoms of the grooves 42 to hold the top, left and right edges of the glass plates 14 and 15 within the grooves 42.

Batten members 25 are then fixed by means of screws 26 to the outside of the surfaces defining the opening 41 which correspond to the top or bottom edge of each glass plate 14 or 15. An incombustible filler 27 such as putty is placed in the space between the inside surface of each batten member and each glass plate 14 or 15.

In the above structure, a plurality of vents 28 are provided in the spacers 18, and vents 29 are formed in the surfaces defining the opening 41 in the main body 40, so that the space 21 between the glass plates 14 and 15 can be placed in communication with the outer atmosphere through the vents 28 and 29. Those vents 28 which lead to the intermediate space 21 are closed by a heat-meltable substance 30. Preferably, the heat-meltable substance has a melting point in the range of 100° to 200° C. An example of such a material is a solder composed of 63% tin and 37% lead and having a melting point of 182° C. If vents 28 are provided in the spacer at the upper side, it is likely that even when the substance 30 is melted, it will keep the vents 28 closed due to surface tension. When vents 28 are provided in the vertical spacers 18 in the above-mentioned manner, the substance 30 falls by gravity when it is melted, and the vents 28 can be rapidly changed from the closed state.

The intermediate space 21 between the glass plates 14 and 15 is thus normally sealed air-tight as described hereinabove, and contains dry air or an inert gas having low heat conduction. In the fireproof windowpane having the double structure shown in FIGS. 4 and 5, the heat-meltable substance 30 which closes the vents 28 leading to the intermediate space 21 is melted upon exposure to a fire or high temperatures, thus opening the holes 28. Hence, the intermediate space 21 communicates with the outer air through the vents 28 and 29, and is maintained at the atmospheric pressure even when windowpane is exposed to a fire or high temperatures.

The organic sealing material 23 burns due to the heat of the fire. Since the intermediate space 21 communicates with the outer atmosphere upon opening of the vents 28, the outer air is introduced into the space 21 to supply enough oxygen. This promotes the burning of the organic sealing material 23, and prevents the formation of soot, etc. owing to incomplete combustion, and the adhesion of such matter to the inside surfaces of the glass plates. The smoke generated inside the intermediate space 21 is discharged into the atmosphere through the vents 28 and 29. Transparency of the glass plates can therefore be insured even in the event of fire. This makes it easy to ascertain the occurrence of a fire in a sure manner and its state, and is very advantageous from the standpoint of fire extinguishing activities.

Since vents 28 and 29 which communicate with the outer atmosphere for the first time upon exposure to a fire or high temperatures are provided in the fireproof windowpane of this invention having the aforesaid double glass plate structure, the breakage of the glass plates or detachment from the mounting frame is not facilitated by the thermal expansion of the gas in the intermediate space 21. This advantage cannot be obtained in a conventional fireproof double windowpane structure in which the intermediate space is maintained air-tight even when it is exposed to high temperatures.

Furthermore, since in the fireproof windowpane having the double glass plate structure of this invention, the upper edge portions of the two glass plates are fitted in the grooves of the mounting frame to a depth corresponding to at least 1.6 times the thickness of each glass plate, it does not permit early passage of a fire due to softening and detachment of the glass plates upon exposure to the fire or high temperature.

Figure 6:
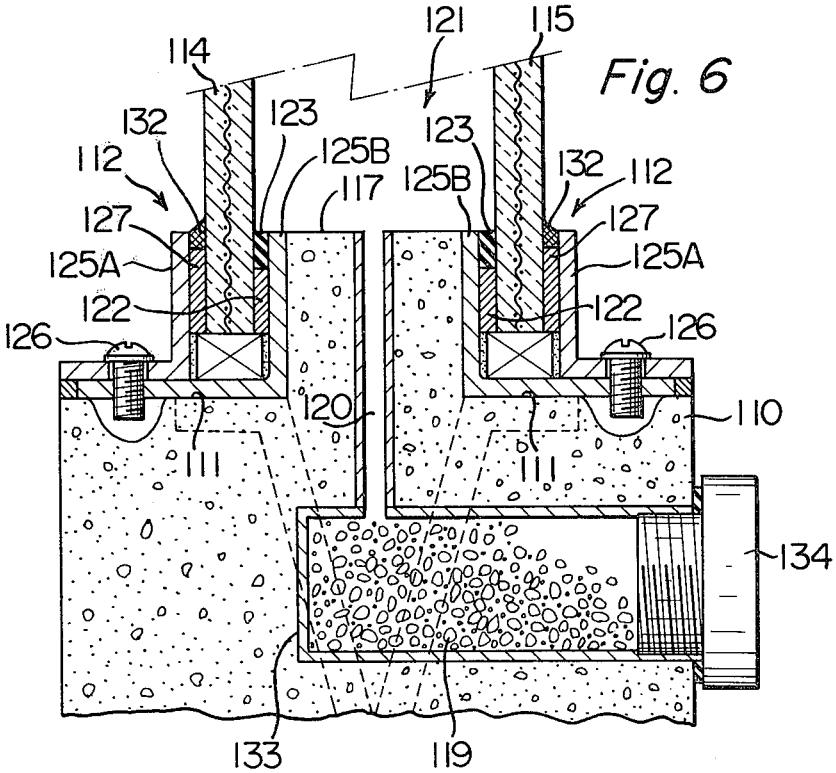
FIG. 6 is an enlarged partial sectional elevation view of a building wall with a double windowpane according to the invention therein, the view being taken through the middle portion of the windowpane.
Figure 7:
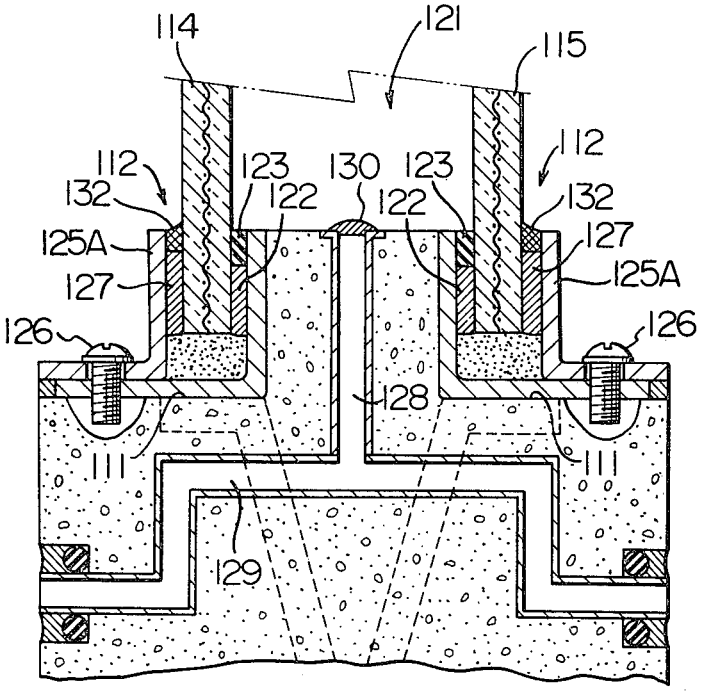
FIG. 7 is an enlarged partial sectional elevation view of the building wall of FIG. 6, the view being taken through the end portion thereof.

FIGS. 6 and 7 show another embodiment in which the fireproof windowpane of this invention having a double glass plate structure is provided in the wall of a building.

Referring to FIGS. 6 and 7, a groove defining spacer 117 is provided on the entire inner surface of the opening in a building wall made of concrete, etc.

Frames 125A and 125B, each being an angle member, forming groove defining members are anchored by means of bolts 126 to inwardly facing portions 111 on both sides of spacer 117, and grooves 112 are thus defined in the inner surfaces of the opening between the frames 125A and spacer 117. Metal wire-containing glass plates 114 and 115 are fitted in the grooves 112. An organic sealing material 123 and an incombustible filler 122 of the types described above in connection with FIGS. 4 and 5 are filled in the space between each glass plate 114 or 115 and the inner wall of each of the grooves 112, and an incombustible filler 127 is filled in the space between each of the glass plates 114 and and 115 and the bottom wall of each groove 112. Thus, the glass plates 114 and 115 are set and supported parallel to each other with an intermediate space 121 therebetween. A sealing material 132 such as a polysulfide sealant is placed on the filler 127 to maintain air- and water-tightness.

A passage 120 is provided in the spacer 117 by embedding a pipe, etc. as shown in FIG. 6 for communication with a storage means 133 for a dessicant 119 which is provided in the wall 110. The storage section is openable and closeable by a threaded lid 134 so as to enable the dessicant 119 to be replaced and thus overcome the degradation of the dessicant due to moisture permeation through the concrete wall and with the consequent dew formation.

A vent 128 is provided as shown in FIG. 7 at the end portion of the spacer 117. It is connected to a branched conduit 129 embedded in the wall 110 so as to enable the vent 128 to communicate with the outer atmosphere. The vent 128 is normally closed by a heat-meltable substance 130.

In this embodiment also, the metal wire-containing glass plates are fitted in the grooves of the mounting frame so that the depth to which of at least their the upper edge extends into the groove is at least about 1.6 times the thickness of each glass plate.

METALLIC FRAME FOR MOUNTING

The present invention also provides a metallic frame for mounting metallic wire-containing glass plates, which frame is used in the fireproof windowpane provided by the present invention.

The general nature and structure of the metallic frame is already clear from the description of the fireproof windowpane given hereinabove with reference to FIGS. 1 to 3. It is described in more detail below with reference to FIGS. 8 to 10.

Figure 8:
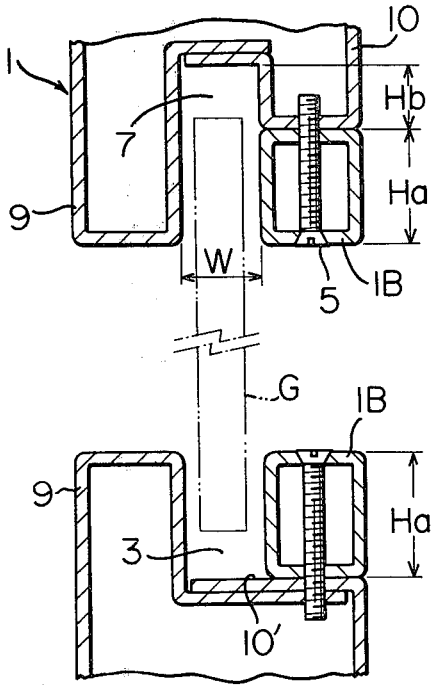
FIG. 8 is a sectional elevation view of a mounting frame for the windowpane according to the invention.
Figure 9:
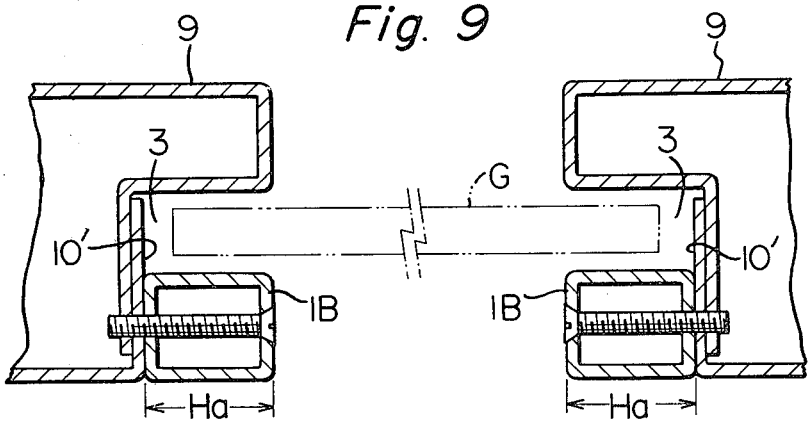
FIG. 9 is a horizontal sectional view of the frame of FIG. 8.

As shown in FIGS. 8 and 9, the frame of this invention is composed of a main body 1 and a batten member 1B detachably secured to the main body 1 by means of a screw 5. The main body 1 is built by bending iron plates and superimposing the bent end portions of these plates in the configuration shown in the drawings, and forming them into a unitary structure. A projecting portion 9 and an inwardly facing portion 10' are provided on the main body 1 of the frame along the inner surface and spaced in the thickness direction. The batten member 1B is secured to the inwardly facing portion 10', and the edge of a wire glass plate G can be held in a groove 3 formed between the laterally facing surface of the projecting portion 9 which faces toward the batten member and the opposed surface of the batten member 1B. A recess 7 is formed in the main body 1 so as to make the groove 3 along the upper side of the frame deeper than the grooves along the other sides of the frame. At the upper side of the frame 1, the dimension of the projecting portion in the direction of its projection is made greater than that of the projecting portions at the other three sides, and the inwardly facing portion 10 protrudes slightly inwardly. The batten member 1B having the same cross sectional dimension as at the other three sides of the frame is secured to the protruding inwardly facing portion 10.

In a specific example of a mounting frame the height Ha of each batten member 1B is 18 mm and the depth Hb of the recess 7 at the upper side of the main body 1 of the frame is 5 mm and is adapted to receive a metallic wire containing glass plate G having a thickness of 6.8 mm to 10 mm. The portion 9 of the frame is built such that its end surface facing the opening is substantially on the same plane as the end surface of the batten member 1B.

Preferably, the width W of the groove 3 is at least 10 mm in order to receive a refractory material such as putty, refractory clay, asbestos or gypsum into the space left after the insertion of the glass plate G. When the clearance (usually called surface clearance) between the surface of the glass plate G in the groove 3 and the side surfaces of the groove 3 is less than 1.5 mm, it is difficult to fill the aforesaid refractory material properly into the surface clearance portion, and therefore, the protection of the edge portion of the glass plate fitted in the groove from heat and fire is insufficient. Hence, the fire resisting property of the metallic wire-containing glass plate cannot be fully realized. Desirably, a surface clearance of at least 1.5 mm should be provided between the two surfaces of the metal wire-containing glass plate and the side surfaces of the groove. For example, in the case of a frame in which is mounted a metal wire-containing glass plate having a thickness of 6.8 mm, it is preferable to make the widths of all of the grooves to at least 10 mm. More preferably, the width should be at least 11 mm in view of the dimensional accuracy of making the frame. When the thickness of the glass plate is 10 mm, the width of the groove is desirably at least 13 mm.

Figure 10:
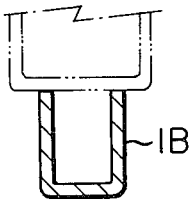
FIG. 10 is a sectional view of a preferred form of a batten member for the frame of FIGS. 8 and 9.

When the main body 1 of the frame has a portion consisting of only one iron plate, the iron plate preferably has a thickness of at least 1.5 mm. When the main body of the frame is made by assembling an iron framework and bonding iron plates to the framework, the iron plates preferably have a thickness of at least 0.5 mm. The rigidity of the main body 1 of the frame is very important in order to make the fire resistant property of the metallic wire-containing glass plate a maximum so that it can withstand the fireproof heating test stipulated in JIS A1311. Desirably, the frame should be made of an iron plate having a thickness of at least 1.6 mm. Likewise, the rigidity of the batten member 1B is important. Preferably, the batten member 1B is a channel-shaped member as shown in FIG. 10 made by bending an iron plate having a thickness of at least 1.2 mm, or an iron pipe having a wall thickness of at least 1.2 mm as illustrated in FIGS. 8 and 9, or a channel-shaped steel plate having a thickness of at least 3 mm.

Thus, according to this invention, there is provided a metallic frame which is used in the fireproof windowpane of this invention by fitting a metallic wire-containing glass plate in the groove of the metallic frame so that at least the upper edge portion is fitted in the groove to a depth corresponding to at least 1.6 times the thickness of the glass plate, and filling an incombustible filler into the spaces defined between the surfaces of the edge portion of the glass plate and the inside surface of the groove.

The following Examples illustrate the present invention more specifically.

EXAMPLE 1

A fireproof door (width 950 mm, height 2100 mm, thickness 40 mm) made of an iron plate having a thickness of 1.6 mm and having the structure shown in FIGS. 1 and 2 was built in which a wire glass plate having a thickness of 6.8 mm, a length of 920 mm and a width of 770 mm containing metallic wires in a rhombic meshwork was fitted with its long side placed in the direction of its height.

The metallic wire-containing glass plate was mounted on a metallic frame such that its upper edge portion was fitted in the groove of the mounting frame to a depth of about 16.3 mm (about 2.4 times the thickness of the glass plate), and its side edges and lower edges were fitted in the groove to a depth of about 9.5 mm (about 1.4 times the thickness of the glass plate). In the lower groove of the mounting frame, the glass plate was supported on a supporting block, and ceramic fibers were filled in the space between the side and upper edges of the glass plate and the bottom surface of the groove. A commercially available glass putty (Class 1 putty stipulated in JIS A5752) composed of calcium carbonate as a main ingredient and titanium white, oil and fat, etc. as additives was filled in the space left in the groove between the two surfaces of the glass plate and the inside surface of the groove to hold the glass plate to the mounting frame.

The fireproof windowpane of this invention in this fireproof door was tested for fire blocking performance in the following manner. The fireproof door was surrounded by reinforced concrete having a thickness of 100 mm firmly adhering to its surfaces in a reinforced concrete wall structure having a height of 3 m and a width of 2.5 m and provided with the fireproof door. The concrete wall structure (30 days after application of concrete) was secured to the opening of a heating test furnace so that the batten members of the fireproof windowpane faced the inside of the test furnace. Then, the inside of the heating test furnace was heated in accordance with the heating temperature schedule stipulated in JIS A1311 as shown in Table 1 below.

TABLE 1

| | | | | | | |
|---|---|---|---|---|---|---|
| Time elapsed (minutes) | 1 | 2 | 3 | 4 | 5 | 6 |
| Heating temperature (°C.) | 100 | 220 | 330 | 440 | 540 | 600 |
| Time elapsed (minutes) | 7 | 8 | 9 | 10 | 11 | 12 |
| Heating temperature (°C.) | 640 | 665 | 685 | 705 | 715 | 730 |
| Time elapsed (minutes) | 13 | 14 | 15 | 16 | 17 | 18 |
| Heating temperature (°C.) | 740 | 750 | 760 | 770 | 775 | 785 |
| Time elapsed (minutes) | 19 | 20 | 21 | 22 | 23 | 24 |
| Heating temperature (°C.) | 790 | 795 | 800 | 805 | 810 | 815 |
| Time elapsed (minutes) | 25 | 26 | 27 | 28 | 29 | 30 |
| Heating temperature (°C.) | 820 | 825 | 830 | 835 | 838 | 840 |
| Time elapsed (minutes) | 35 | 40 | 45 | 50 | 55 | 60 |
| Heating temperature (°C.) | 860 | 880 | 895 | 905 | 915 | 925 |
| Time elapsed (minutes) | 65 | 70 | 75 | 80 | 85 | 90 |
| Heating temperature (°C.) | 935 | 945 | 955 | 965 | 975 | 980 |
| Time elapsed (minutes) | 95 | 100 | 110 | 120 | | |
| Heating temperature (°C.) | 985 | 990 | 1000 | 1010 | | |

Even after 120 minutes (1010° C.), no hole which would permit passage of the fire formed in the fireproof windowpane of this invention.

The same test sample was heated in the same way as above except that it was secured to the opening of the heating furnace such that the batten members of the fireproof windowpane faced away from the inside of the heating test furnace. After 80 minutes (965° C.), the frame of the door curved toward the fire (inside of the test furnace) to form a space between the main body of the door and the frame, thus permitting passage of fire. After 100 minutes (990° C.), the glass plate partly dropped from the main body of the door owing to the deformation of its frame. Thus, the fire passed through the windowpane.

On the other hand, a fireproof door having the same structure as above was built except that all the edges of the glass plate were fitted to a depth of about 6.8 mm (substantially equal to the thickness of the glass plate) in the grooves of the mounting frame. The resulting fireproof door was tested in the same way as above. When it was heated from the side of the batten members, the upper edge portion of the glass plate became detached from the groove after 55 minutes to form a hole. When it was heated from the opposite side, the same phenomenon occurred after 45 minutes to form a hole. In both cases, the fire passed through the hole.

EXAMPLE 2

A fireproof door having the structure shown in FIG. 3 was built which was different from the fireproof door used in Example 1 in that channel-shaped reinforcing beams were used. The fireproof door was secured to the same heating test furnace as in Example 1, and heated in accordance with the same heating temperature schedule.

When the sample was heated from either side, no change was noted and the passage of the fire was completely stopped even after a 120 minutes.

EXAMPLE 3

The same fireproof door as used in Example 2 was subjected to a heating test stipulated in ISO 834. The heating temperature schedule in accordance with ISO 834 is given by the following equation.

$$\theta_T - \theta_O = 345 \log_{10}(8T+1)$$

wherein

T is the heating time elapsed (minutes), $\theta_T$ is the heating temperature (°C.) at the time T elapsed, and $\theta_O$ is the temperature (°C.) of the inside of the heating furnace before the start of heating.

The sample used in the heating test was mounted in reinforced concrete in the same way as in Example 1, and the sample was secured to the opening of the heating furnace in this test.

When it was heated from the side of the batten members, no hole was formed and passage of fire was stopped until a period of 180 minutes elapsed. When it was heated from the side opposite to the batten members, small holes formed in the glass plate after 140 minutes, and the fire was seen to pass through the small holes.

EXAMPLE 4

A main body of a fireproof door having a width of 850 mm, a height of 1100 mm and a thickness of 40 mm was built from an iron plate having a thickness of 1.6 mm. A metallic wire-containing glass plate having a thickness of 6.8 mm, a width of 610 mm and a height of 700 mm was mounted on a mounting frame set in the opening portion of the door such that the upper edge portion of the glass plate was fitted in the groove of the frame to a depth of about 15 mm (corresponding to about 2.2 times the thickness of the glass plate) and the other edge portions of the glass plate were fitted to a depth of about 7 mm. Thus, a fireproof door equipped with a fireproof windowpane having the same structure as in FIG. 1 was built.

A ceramic fiber material impregnated with hydrous sodium silicate was filled in each of the spaces defined between the inside surface of the groove of the frame and the edge portions of the glass plate fitted in the groove so that the filler reached the bottom of the groove, and then a polysulfide sealant was filled in above the ceramic fiber filler to a depth of 3 mm.

The above ceramic fiber material was produced by uniformly impregnating a soft braid-like ceramic fiber mat (the braid being made of "Kaowool", a trademark for a product of Isolite Babcock Co.) having a unit weight of 21 g/m and a diameter of 9 mm with a solution of 18 g of commercially available water glass ($Na_2O.3SiO_2$) in 8 g of water per meter of the ceramic fiber article, and then placing the article in a hot air bath at 80° C. to solidify the sodium silicate.

A reinforced concrete wall structure was built by using the above fireproof door in the same way as in Example 1. It was secured to a heating test furnace so that the batten members faced the inside of the furnace, and heated in accordance with the heating temperature schedule stipulated in JIS A1311. The results are shown in Table 2.

Table 2 also shows the results of the same heating test as above which was conducted on two conventional fireproof doors which differed from the fireproof door of this invention in that the depth of insertion of the upper edge portion of the glass plate in the groove of the mounting frame was about 6.8 mm (nearly equal to the thickness of the glass plate) and about 8.3 mm (about 1.2 times the thickness of the glass plate).

In each of the above specimens, two different glass plates were used, one containing metallic wires in a lattice meshwork parallel to the edges of the glass plate, and the other containing metallic wires in a rhombic meshwork.

TABLE 2

| | Depth of insertion of the upper edge of the glass in the groove (mm) | Time (minutes) required until the fire passed through the sample | |
|---|---|---|---|
| | | Rhombic meshwork | Lattice meshwork |
| Fireproof door equipped with the windowpane of this invention | 15 | 120 | 120 |
| Fireproof door equipped with the windowpane of the prior art | 6.8 | 80 | 70 |
| | 8.2 | 90 | 70 |

It is seen from the results obtained that even in a glass windowpane using a filler impregnated with hydrous sodium silicate, the windowpanes of the conventional structure do not have sufficient fire blocking performance, and the windowpane of this invention has far better fire blocking ability than these conventional windowpanes.

What we claim is:

1. A fireproof windowpane containing structure comprising:

a metallic wire-containing glass plate;

a metal mounting frame means having a main body extending around and defining an opening to be covered by said glass plate, said main body having a surface facing into said opening, a groove defining projecting portion projecting from said surface into said opening around the entire periphery of said opening, an inwardly facing portion on said surface spaced in the direction of the thickness of said frame means from said projecting portion, at least the portion of said surface along the portion of said frame means which is to be at the top of the frame when the structure is in use having a recess therein between said projecting portion and said inwardly facing portion, and a groove defining member on said inwardly facing portion extending inwardly into said opening from said surface and having the inner end flush with the inner end of said projecting portion, said groove defining member, inwardly projecting portion and said recess defining a groove;

said glass plate being mounted in said frame means with the edges of said glass plate extending into said groove, at least the part of the edge of the glass plate which is to be at the top of the frame means when the structure is in use extending into said groove a distance at least 1.6 times the thickness of the glass plate; and an incombustible filler material between at least the surfaces along the edge of the glass plate and the surfaces of said groove defining member and said projecting portion defining groove.

2. A structure as claimed in claim 1 in which said part of the edge of said glass plate extends into said groove a distance at least about 2.0 times the thickness of said glass plate.

3. A structure as claimed in claim 1 in which the parts of the edge of the glass plate which are to be at the sides of the frame means when the structure is in use extend into said groove a distance at least 1.6 times the thickness of said glass plate.

4. A structure as claimed in claim 1 in which said incombustible filler is a filler material which is incombustible and which contains hydrous sodium silicate.

5. A structure as claimed in claim 1 in which said structure is a fire resistant door in which said frame means is formed.

6. A fireproof windowpane containing structure comprising:

a plurality of parallel metallic wire-containing glass plates;

a metal mounting frame means having a main body extending around and defining an opening covered by said glass plates, said main body having a surface facing into said opening, a groove defining projecting portion projecting from said surface into said opening around the entire periphery of said opening between each pair adjacent glass plates, an inwardly facing portion on said surface spaced outwardly in the direction of the thickness of said frame means from the outermost, in said thickness direction, of each of said projecting portions, and a groove defining member on each of said inwardly facing portions extending inwardly into said opening from said surface and having the inner end flush with the inner end of said projecting portions, said groove defining members and inwardly projecting portions defining grooves;

said glass plates being mounted in said frame means with the edges of said glass plates extending into said grooves;

an incombustible filler material between at least the surfaces along the edge of the glass plates and the surfaces of said groove defining members and said projecting portions defining said grooves;

said groove defining projecting portions having vent means therein communicating the spaces between said pairs of adjacent glass plates with the atmosphere around said structure; and a heat meltable substance closing said vent means.

7. A structure as claimed in claim 6 in which said structure is a fire resistant door in which said frame means is formed.

* * * * *